US009138851B2

(12) United States Patent
Ueda et al.

(10) Patent No.: US 9,138,851 B2
(45) Date of Patent: Sep. 22, 2015

(54) METHOD OF MANUFACTURING MEMBER MADE BY STAINLESS STEEL AND METHOD OF MANUFACTURING COATING FILM

(75) Inventors: Tadashi Ueda, Kanagawa (JP); Kazuya Kojima, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 563 days.

(21) Appl. No.: 13/439,625

(22) Filed: Apr. 4, 2012

(65) Prior Publication Data

US 2012/0255159 A1 Oct. 11, 2012

(30) Foreign Application Priority Data

Apr. 5, 2011 (JP) ..... P2011-083746
Aug. 30, 2011 (JP) ..... P2011-187558

(51) Int. Cl.

| | |
|---|---|
| ***B24B 1/00*** | (2006.01) |
| ***B24B 9/00*** | (2006.01) |
| ***B05D 1/26*** | (2006.01) |
| *B05C 5/02* | (2006.01) |

(52) U.S. Cl.

CPC ... *B24B 9/00* (2013.01); *B05D 1/26* (2013.01); *B24B 1/00* (2013.01); *B05C 5/0254* (2013.01); *Y10T 29/49986* (2015.01)

(58) Field of Classification Search

CPC ..... B24B 1/00; B24B 9/00; Y10T 29/49986; B05C 5/025; B05D 1/26
USPC ..... 451/45, 57–59
See application file for complete search history.

(56) References Cited

U.S. PATENT DOCUMENTS

| | | | | | |
|---|---|---|---|---|---|
| 2,403,434 | A | * | 7/1946 | Gulden | 451/461 |
| 2,646,653 | A | * | 7/1953 | Murchison | 451/486 |
| 2,648,174 | A | * | 8/1953 | Bikles | 451/194 |
| 4,504,283 | A | * | 3/1985 | Charvat | 451/526 |

(Continued)

FOREIGN PATENT DOCUMENTS

| | | | | |
|---|---|---|---|---|
| JP | S61-198118 | A | 9/1986 | |
| JP | 03092266 | A * | 4/1991 | B24B 49/00 |

(Continued)

OTHER PUBLICATIONS

Notice of Reasons for Rejection for Japanese Application No. JP2011-187558, mailed Aug. 11, 2014, with English Language translation.

(Continued)

*Primary Examiner* — Maurina Rachuba
(74) *Attorney, Agent, or Firm* — Birch, Stewart, Kolasch & Birch, LLP

(57) ABSTRACT

Provided is a method of manufacturing a member made by stainless steel, which is capable of preventing a burr from being folded from the root and a sharp edge from being chipped. A method of manufacturing a member made by stainless steel, in which a member having a sharp edge is manufactured by grinding stainless steel, includes grinding a face which forms the sharp edge of the stainless steel in the longitudinal direction of the sharp edge, grinding both side faces, which come into contact with each other in the longitudinal direction of the sharp edge, from the non-tip-end face of the sharp edge toward a tip-end direction of the sharp edge while grinding both the side faces in the longitudinal direction of the sharp edge, and polishing the face which forms the sharp edge by moving a polishing unit in the longitudinal direction of the sharp edge.

14 Claims, 10 Drawing Sheets

(56) References Cited

U.S. PATENT DOCUMENTS

| | | | | |
|---|---|---|---|---|
| 7,037,175 | B1 * | 5/2006 | Spiro et al. | 451/45 |
| 7,238,237 | B2 * | 7/2007 | Tokimasa et al. | 118/410 |
| 7,264,542 | B1 * | 9/2007 | Leyva | 451/494 |
| 8,308,532 | B2 * | 11/2012 | Usui et al. | 451/533 |
| 2007/0092655 | A1 * | 4/2007 | Tokimasa et al. | 427/355 |

FOREIGN PATENT DOCUMENTS

| | | | |
|---|---|---|---|
| JP | 11-506397 | A | 6/1999 |
| JP | 2000-288888 | A | 10/2000 |
| JP | 2001286805 | A | 10/2001 |
| JP | 2003-175354 | A | 6/2003 |
| JP | 2005-118981 | A | 5/2005 |
| JP | 2009-050996 | A | 3/2009 |
| JP | 2009-138265 | A | 6/2009 |
| JP | 2010149258 | A | 7/2010 |
| WO | 96/39276 | A1 | 12/1996 |

OTHER PUBLICATIONS

Notice of Reasons for Rejection for Japanese Application No. JP2011-083746, dated Sep. 29, 2014, with English language translation.

* cited by examiner

FIG. 5A

TABLE 1

| | SUS MATERIAL | BLOCK WIDTH (mm) | GRINDING DIRECTION | GRINDING AND POLISHING SEQUENCE |
|---|---|---|---|---|
| EXAMPLE 1 | SUS630 | 1,000 | LONGITUDINAL DIRECTION OF SHARP EDGE | A→B→C→A |
| EXAMPLE 2 | SUS329J1 | 1,000 | ↓ | A→B→C→A |
| EXAMPLE 3 | ASL438 | 1,300 | ↓ | A→C→B→A |
| COMPARATIVE EXAMPLE 1 | SUS329J1 | 1,200 | ↓ | B→A→C→A |
| COMPARATIVE EXAMPLE 2 | SUS630 | 1,000 | ↓ | A→B→C→A |
| COMPARATIVE EXAMPLE 3 | SUS630 | 1,000 | VERTICAL DIRECTION WITH RESPECT TO THE LONGITUDINAL DIRECTION OF SHARP EDGE | A→B→C→A |
| COMPARATIVE EXAMPLE 4 | ASL438 | 1,000 | ↓ | A→C→B→A |
| COMPARATIVE EXAMPLE 5 | SUS630 | 1,400 | ↓ | A→B→C→A |
| COMPARATIVE EXAMPLE 6 | SUS630 | 300 | ↓ | A→B→C→A |

FIG. 5B

TABLE 1

| | DEBURRING POLISHING DIRECTION | KINDS OF ABRASIVE GRAINS | HARDNESS OF SPONGE MATERIAL (DEGREE) |
|---|---|---|---|
| EXAMPLE 1 | LONGITUDINAL DIRECTION | #4000 | 20 |
| EXAMPLE 2 | ↓ | #8000 | 18 |
| EXAMPLE 3 | ↓ | #4000 | 21 |
| COMPARATIVE EXAMPLE 1 | ↓ | #8000 | 23 |
| COMPARATIVE EXAMPLE 2 | VERTICAL DIRECTION | #4000 | 25 |
| COMPARATIVE EXAMPLE 3 | LONGITUDINAL DIRECTION | #8000 | 23 |
| COMPARATIVE EXAMPLE 4 | ↓ | #2000 | 28 |
| COMPARATIVE EXAMPLE 5 | ↓ | #4000 | 55 |
| COMPARATIVE EXAMPLE 6 | ↓ | #4000 | 45 |

FIG. 5C

TABLE 1

| | DEBURRING SITUATION | LIP CHIPPING | OVERALL EVALUATION |
|---|---|---|---|
| EXAMPLE 1 | PREFERABLE | NONE | A |
| EXAMPLE 2 | PREFERABLE | NONE | A |
| EXAMPLE 3 | PREFERABLE | NONE | A |
| COMPARATIVE EXAMPLE 1 | SINCE DIRECTION OF BURR IS UNEVEN, DEBURRING IS IMPOSSIBLE | CHIPPING OCCUR | C |
| COMPARATIVE EXAMPLE 2 | BAD (CHIPPING OF 100 μm OR MORE OCCUR | CHIPPING OCCUR | D |
| COMPARATIVE EXAMPLE 3 | BAD (CHIPPING OF 100 μm OR MORE OCCUR | CHIPPING OCCUR | D |
| COMPARATIVE EXAMPLE 4 | DEBURRING OF BURR OF APPROXIMATELY 2 μm IS IMPOSSIBLE | NONE | B~C |
| COMPARATIVE EXAMPLE 5 | BAD | CHIPPING OCCUR | C |
| COMPARATIVE EXAMPLE 6 | MINUTE BURR OF 1 μm OR LESS IS PRESENT | NONE | B |

FIG. 6A

TABLE 2

| | SUS MATERIAL | HARDNESS OF SPONGE MATERIAL (DEGREE) | KINDS OF ABRASIVE GRAINS | DEBURRING TIME |
|---|---|---|---|---|
| EXAMPLE 1-1 | SUS630 | 20 | #4,000 | 10 MINUTES |
| EXAMPLE 1-2 | SUS329J1 | ↓ | #6,000 | 13 MINUTES |
| EXAMPLE 1-3 | ASL438 | ↓ | #8,000 | 20 MINUTES |
| EXAMPLE 1-4 | SUS630 | ↓ | #10,000 | 30 MINUTES |
| COMPARATIVE EXAMPLE 1-1 | SUS329J1 | ↓ | #2,000 | 5 MINUTES |
| COMPARATIVE EXAMPLE 1-2 | SUS630 | ↓ | #15,000 | 1 HOUR |
| COMPARATIVE EXAMPLE 1-3 | SUS630 | 40 | #4,000 | 10 MINUTES |
| COMPARATIVE EXAMPLE 1-4 | ASL438 | 60 | #6,000 | 13 MINUTES |
| COMPARATIVE EXAMPLE 1-5 | SUS630 | 30 | #8,000 | 20 MINUTES |
| COMPARATIVE EXAMPLE 1-6 | SUS630 | 25 | #10,000 | 30 MINUTES |

FIG. 6B

TABLE 2

| | DEBURRING SITUATION | LIP CHIPPING | OVERALL EVALUATION |
|---|---|---|---|
| EXAMPLE 1-1 | PREFERABLE | NONE | A |
| EXAMPLE 1-2 | PREFERABLE | NONE | A |
| EXAMPLE 1-3 | PREFERABLE | NONE | A |
| EXAMPLE 1-4 | PREFERABLE | NONE | A |
| COMPARATIVE EXAMPLE 1-1 | DEBURRING OF BURR OF APPROXIMATELY 2 μm IS IMPOSSIBLE | CHIPPING OCCUR | E |
| COMPARATIVE EXAMPLE 1-2 | PREFERABLE (HOWEVER, DEBURRING TIME IS TAKEN, SUCH THAT IT IS INEFFICIENT) | NONE | B~C |
| COMPARATIVE EXAMPLE 1-3 | BAD | CHIPPING OCCUR | E |
| COMPARATIVE EXAMPLE 1-4 | BAD | CHIPPING OCCUR | C~D |
| COMPARATIVE EXAMPLE 1-5 | PREFERABLE | NONE | A |
| COMPARATIVE EXAMPLE 1-6 | PREFERABLE | NONE | B |

FIG. 7A

TABLE 3

| | SUS MATERIAL | GRINDING DIRECTION | GRINDING SEQUENCE | KINDS OF ABRASIVE GRAINS |
|---|---|---|---|---|
| EXAMPLE 2-1 | SUS630 | WIDTH DIRECTION OF DIE BLOCK | A→B→C→A | #4000 |
| EXAMPLE 2-2 | SUS329J1 | ↓ | A→B→C→A | #8000 |
| EXAMPLE 2-3 | ASL438 | ↓ | A→C→B→A | #4000 |
| COMPARATIVE EXAMPLE 2-1 | SUS329J1 | ↓ | B→A→C | #8000 |
| COMPARATIVE EXAMPLE 2-3 | SUS630 | VERTICAL DIRECTION WITH RESPECT TO WIDTH DIRECTION OF DIE BLOCK | A→B→C→A | #8000 |
| COMPARATIVE EXAMPLE 2-4 | ASL438 | ↓ | A→C→B→A | #2000 |
| COMPARATIVE EXAMPLE 2-5 | SUS630 | ↓ | A→B→C→A | #4000 |
| COMPARATIVE EXAMPLE 2-6 | SUS630 | ↓ | A→B→C→A | #4000 |

FIG. 7B

TABLE 3

| | HARDNESS OF SPONGE MATERIAL (DEGREE) | DEBURRING SITUATION | LIP CHIPPING | OVERALL EVALUATION |
|---|---|---|---|---|
| EXAMPLE 2-1 | 20 | PREFERABLE | NONE | A |
| EXAMPLE 2-2 | 18 | PREFERABLE | NONE | A |
| EXAMPLE 2-3 | 21 | PREFERABLE | NONE | A |
| COMPARATIVE EXAMPLE 2-1 | 23 | SINCE DIRECTION OF BURR IS UNEVEN, DEBURRING IS IMPOSSIBLE | CHIPPING OCCUR | D |
| COMPARATIVE EXAMPLE 2-3 | 23 | BAD (CHIPPING OF 100 μm OR MORE OCCUR | CHIPPING OCCUR | E |
| COMPARATIVE EXAMPLE 2-4 | 28 | DEBURRING OF BURR OF APPROXIMATELY 2 μm IS IMPOSSIBLE | NONE | C~D |
| COMPARATIVE EXAMPLE 2-5 | 55 | BAD | CHIPPING OCCUR | D |
| COMPARATIVE EXAMPLE 2-6 | 45 | MINUTE BURR OF 1 μm OR LESS IS PRESENT | NONE | C |

METHOD OF MANUFACTURING MEMBER MADE BY STAINLESS STEEL AND METHOD OF MANUFACTURING COATING FILM

BACKGROUND OF THE INVENTION

1. Field of the Invention

The present invention relates to a method of manufacturing a member made by stainless steel and a method of manufacturing a coating film, and more particularly, to a method of manufacturing a member made by stainless steel to produce a member having a sharp edge by grinding stainless steel, and a method of manufacturing a coating film in which a coating-liquid is coated using the member made by stainless steel manufactured by the method.

2. Description of the Related Art

A method of coating various kinds of coating-liquid to a base that travels by using a slot die is known in the related art As a material of a die block of the slot die, stainless steel has been frequently used, but since the forming of a sharp edge is difficult, the material has shifted to an ultrahard material. However, the ultrahard material has a problem in corrosion resistance, and the ultrahard material is expensive and therefore is used only at the tip-end of the lip of the slot die. As a result, the ultrahard material is assembled only at the tip-end of a stainless steel block of the related art.

However, when coating multiple layers with the slot die so as to correspond to recent demands for increased production speeds, an ultrahard fixing member formed at the lip tip-end is obstructive and therefore it is difficult to form a heat retention hole at an intermediate block of the die. Since heat retention becomes impossible, and the die block is thermally deformed, a coating gap becomes uneven in the width direction, and it becomes difficult to suppress unevenness in the width direction of the film thickness.

To solve the problems, the present inventors sought a material allowing the sharp edge processing and having high hardness and corrosion resistance, and found that, for example, there was such a material such as age-hardened stainless steel disclosed in JP2009-138265A.

Therefore, the present inventors tried to form a sharp edge in the age-hardened stainless steel. However, since stainless steel has a tenacity higher than that of the ultrahard material, burrs are generated. When the removal of the burrs is attempted, there is a problem in that the burrs fold from the root and the sharp edge is chipped. In addition, as a method of polishing the burrs, a method disclosed in JP1999-506397A (JP-H11-506397A) may be exemplified.

SUMMARY OF THE INVENTION

However, in the method disclosed in JP1999-506397 (JPH11-506397A) or a polishing method in the related art, a problem of the burrs folding from the root and the sharp edge being chipped when a sharp edge is formed in the stainless steel is not solved.

The present invention has been made in view of the above-mentioned problems and an object of the present invention is to provide a method of manufacturing a member made by stainless steel which is capable of preventing burrs from being folded from the root and a sharp edge from being chipped when forming a sharp edge in stainless steel and a method of manufacturing a coating film in which a coating-liquid is coated using the member made by stainless steel manufactured by the method.

According to a first invention of the present invention, there is provided a method of manufacturing a member made by stainless steel in which a member having a sharp edge is manufactured by grinding stainless steel, the method includes a step of grinding a face which forms the sharp edge of the stainless steel in the longitudinal direction of the sharp edge, a step of grinding both side faces, which come into contact with each other in the longitudinal direction of the sharp edge, from the non-tip-end face of the sharp edge toward the tip-end direction of the sharp edge while grinding both the side faces in the longitudinal direction of the sharp edge, and a step of polishing the face which forms the sharp edge by moving a polishing unit in the longitudinal direction of the sharp edge.

According to the first invention, after grinding a face which forms the sharp edge, one sharp-edge-forming side face and the other sharp-edge-forming side face that come into contact with each other in the longitudinal direction of the sharp edge are ground in this order, the face which forms the sharp edge is polished by moving a polishing unit in the longitudinal direction of the sharp edge, such that burrs may be tidily removed, and therefore chipping of the sharp edge may be prevented from occurring. In addition, in the first invention, the side faces are ground from the non-tip-end face of the sharp edge toward a tip-end direction of the sharp edge while grinding the side faces in the longitudinal direction of the sharp edge, such that the burrs are formed toward the tip-end direction of the sharp edge. Therefore, the burrs may be tidily removed by polishing the burrs formed to face the tip-end direction of the sharp edge in the longitudinal direction of the sharp edge, and therefore chipping of the sharp edge may be prevented from occurring.

In addition, in the first invention, the width of the sharp edge may be 150 μm or less.

In a case where the burrs remain and therefore chipping of the sharp edge occurs, the smaller the width of the sharp edge is, the more significant the problem becomes. Therefore, an effect of the first invention, that is, an effect of tidily removing the burrs, becomes significant when the width of the sharp edge is small, such as a value of 150 μm or less.

In addition, in the first invention, the polishing unit may include a first layer of abrasive grains, a second layer of a soft member, and a third layer of a supporting body having a rigidity higher than that of the second layer.

According to this configuration, when a soft material which has a cushion property, such as sponge or rubber, is provided between the abrasive grain layer and the supporting body as a polishing unit, it is possible to remove the burrs without applying a load to the burrs, such that chipping of the sharp edge does not occur.

In addition, in the first invention, the stainless steel may be a member for a slot die, and the sharp edge may be a lip face of the slot die.

The method of manufacturing the member made by stainless steel, which is configured as described above, may be appropriately used in a case in which the lip of the slot die is set as a sharp edge. Particularly, the member made by stainless steel manufactured by the method may be suitably used as a slot die or a member thereof for a coating film (optical film) as a thin film in which an even film thickness in the film width direction is required.

In addition, according to a second invention of the present invention, there is provided a method of manufacturing a coating film. The method includes coating a coating-liquid onto a base using the slot die manufactured by the method of manufacturing the member made by stainless steel according to the first invention.

In addition, according to a third invention of the present invention, there is provided a method of manufacturing a member made by stainless steel, in which a member having a sharp edge is manufactured from stainless steel. The method includes a step of grinding a face which forms the sharp edge and both side faces, which come into contact with each other in the longitudinal direction of the sharp edge, of the stainless steel, and a step of polishing the face which forms the sharp edge. The step of polishing of the face which forms the sharp edge is performed using a polishing unit including a first layer of abrasive grains, a second layer of a soft member, and a third layer of a supporting body having a rigidity higher than that of the second layer in order from the side that comes into contact with the face which forms the sharp edge.

According to this configuration, after grinding the face which forms the sharp edge and both the side faces, which come into contact with each other in the longitudinal direction of the sharp edge, of the stainless steel, the face which forms the sharp edge is polished, and this polishing is performed using the polishing unit including the first layer of the abrasive grains, the second layer of the soft member, and the third layer of the supporting body having a rigidity higher than that of the second layer in order from the side that comes into contact with the face which forms the sharp edge, such that burrs may be tidily removed and therefore chipping of the sharp edge is prevented from occurring. That is, when the sharp-edge forming face is polished using a polishing unit in which a soft material, which has a cushion property such as the sponge and rubber, is provided between the abrasive grain layer and the supporting body as a polishing unit, it is possible to remove the burrs without applying a load to the burrs, and therefore chipping of the sharp edge does not occur. In addition, the sharp edge in the third invention has a width of approximately 150 μm or less.

In addition, in the third invention, the size of the abrasive grains may be #2500 or more. When the size of the abrasive grains is set to a fine number of #2500 or more, it is possible to remove the burrs without applying a load to the burrs in a more preferable manner, and therefore chipping of the sharp edge does not occur. In addition, in regard to the numbers of the abrasive grains, in general, the following relationship is established: (a size of the abrasive grains)=15000/(number of the abrasive grains). For example, when the number of the abrasive grains is #10000, the size (diameter) of the abrasive grains is approximately 1.5 μm.

In addition, in the third invention, hardness of the soft member may be 35 or less. When the hardness of the soft member is set to a soft hardness of 35 or less, it is possible to remove the burrs without applying a load to the burrs in a more preferable manner, and therefore chipping of the sharp edge does not occur. In addition, the hardness of the soft member is a measurement compliant to SRIS 0101 defined by Society of Rubber Industry, Japan. Specifically, the hardness is a value measured by an Asker-FP type of a rubber hardness meter manufactured by KOBUNSHI KEIKI CO., LTD.

In addition, in the third invention, the steps of grinding of a face which forms the sharp edge and both side faces of the stainless steel may include a step of grinding a face which forms the sharp edge of the stainless steel in the longitudinal direction of the sharp edge, and grinding both side faces, which come into contact with each other in the longitudinal direction of the sharp edge, from the non-tip-end face of the sharp edge toward a tip-end direction of the sharp edge while grinding both the side faces in the longitudinal direction of the sharp edge, and the polishing of the face which forms the sharp edge may include polishing the face which forms the sharp edge by moving a polishing unit in the longitudinal direction of the sharp edge.

According to this configuration, after grinding a face which forms the sharp edge, one sharp-edge-forming side face and the other sharp-edge-forming side face that come into contact with each other in the longitudinal direction of the sharp edge are ground in this order, the face which forms the sharp edge is polished by moving a polishing unit in the longitudinal direction of the sharp edge, such that burrs may be tidily removed, and therefore chipping of the sharp edge may be prevented from occurring. In addition, the side faces are ground from the non-tip-end face of the sharp edge toward a tip-end direction of the sharp edge while grinding the side faces in the longitudinal direction of the sharp edge, such that the burrs are formed toward the tip-end direction of the sharp edge. Therefore, when the burrs formed to face the tip-end direction of the sharp edge is polished in the longitudinal direction of the sharp edge, the burrs may be tidily removed, and therefore chipping of the sharp edge may be prevented from occurring.

In the third invention, the stainless steel may be a member for a slot die, and the sharp edge may be a lip face of the slot die.

Furthermore, the method of manufacturing the member made by stainless steel according to the third invention may be appropriately used in a case in which the lip of the slot die is put into a sharp edge. Particularly, the member made by stainless steel manufactured by the method may be suitably used as a slot die or a member thereof for a coating film (optical film) as a thin film in which an even film thickness in the film width direction is required.

In addition, according to a fourth invention of the present invention, there is provided a method of manufacturing a coating film. The method includes coating a coating-liquid onto a base using the slot die manufactured by the method of manufacturing the member made by stainless steel according to the third invention.

As described above, according to the method of manufacturing the member made by stainless steel and the method of manufacturing the coating film related to the first to fourth inventions, it is possible to prevent burrs from being folded from the root and a sharp edge from being chipped when forming the sharp edge in the stainless steel.

BRIEF DESCRIPTION OF THE DRAWINGS

FIG. 5 is a table diagram illustrating Example A according to the first invention.

FIG. 6 is a table diagram illustrating Example B according to the third invention.

FIG. 7 is a table diagram illustrating Example B according to the third invention.

DESCRIPTION OF THE PREFERRED EMBODIMENTS

Hereinafter, preferred embodiments of a method of manufacturing a member made by stainless steel and a method of manufacturing a coating film related to the first to fourth inventions of the present invention will be described in detail with reference to the attached drawings.

Figure 1:
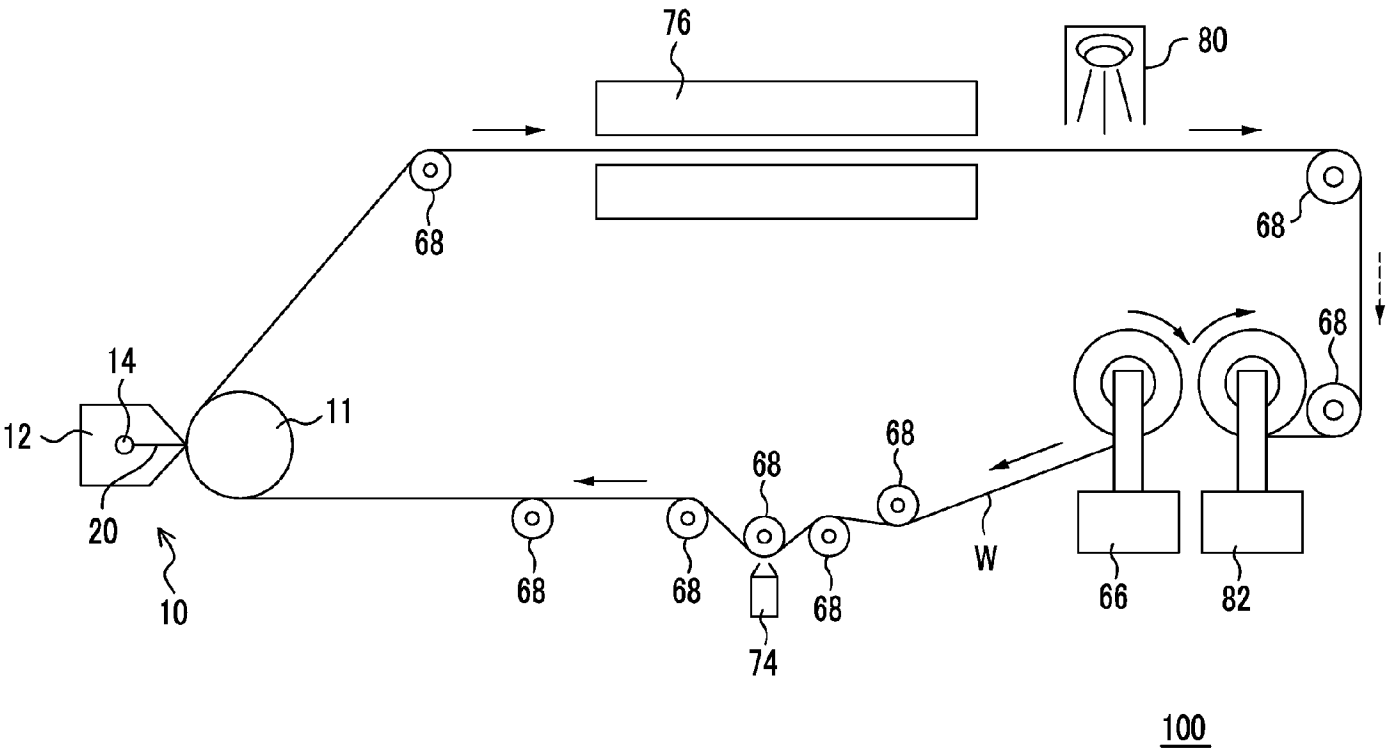
FIG. 1 is a configuration diagram illustrating an entire configuration of an optical film manufacturing line to which a slot die manufactured by a method of manufacturing of a member made by stainless steel according to a first invention and a third invention of the present invention is applied.

FIG. 1 is a configuration diagram illustrating an overall configuration of an optical film manufacturing line 100 to which a slot die manufactured by a method of manufacturing of a member made by stainless steel according to a first invention and a third invention of the present invention is applied.

As shown in FIG. 1, the optical film manufacturing line 100 is configured in a manner such that a web W, which is a transparent base on which a polymer layer is formed in advance, is unwound from a unwinding unit 66. The web W is guided by a guide roller 68 and is conveyed to a dust collector 74. The dust collector 74 is configured to remove dust attached to a surface of the web W.

To the downstream of the dust collector 74, a slot die 12 of an extrusion type slot die coater that is an application unit is provided to coat a coating-liquid onto the web W that is wound around a back-up roll 11.

To the downstream of the slot die 12, a drying zone 76 is provided to dry a solvent contained in a coated layer on the web W. Furthermore, to the downstream of the drying zone 76, an ultraviolet-ray irradiating device 80, which is a curing device of the coated layer, is provided to cure a resin in the coated layer through ultraviolet-ray irradiation. In addition, the web W on which a polymer is formed is wound by a winder 82 provided to the downstream of the ultraviolet-ray irradiating device 80.

In addition, guide rollers 68, 68, . . . , which support the web W in a wound state and tighten the web W so as to convey it, are provided approximately throughout the optical film manufacturing line 100. Each of the guide rollers 68 is a rotatable roller member and has a length that is approximately the same as the width of the web W (in this embodiment, the length is longer than the width of the web W a little).

The above-described extrusion type slot die coater (slot die 12) may be suitably applied to an optical film manufacturing line in which low-viscosity thin film coating is performed at a coating-liquid viscosity of $3\times10^{-3}$ Pa·s or less and an coating amount of the coating film of 10 cc/$m^2$ or less.

In this embodiment, the slot die 12 may be provided in a place under a clean atmosphere such as a clean room. At this time, in regard to a degree of cleanliness, a class of 1000 or less is preferable, more preferably a class of 100 or less, and further more preferably a class of 10 or less.

In addition, in the optical film manufacturing line 100 shown in FIG. 1, it is preferable that tension of the web W be set to 100 to 500 N/m.

As a base material used as the web W, a preferable one is selected depending on the use thereof, and specifically, a transparent base is used. As the transparent supporting member, a plastic film is preferably used.

As a polymer that forms the plastic film, cellulose ester (for example, triacetyl cellulose, diacetyl cellulose), polyamide, polycarbonate, polyester (for example, polyethylene terephthalate, polyethylene naphthalate), polystyrene, polyolefin, or the like may be exemplified.

Figure 2:
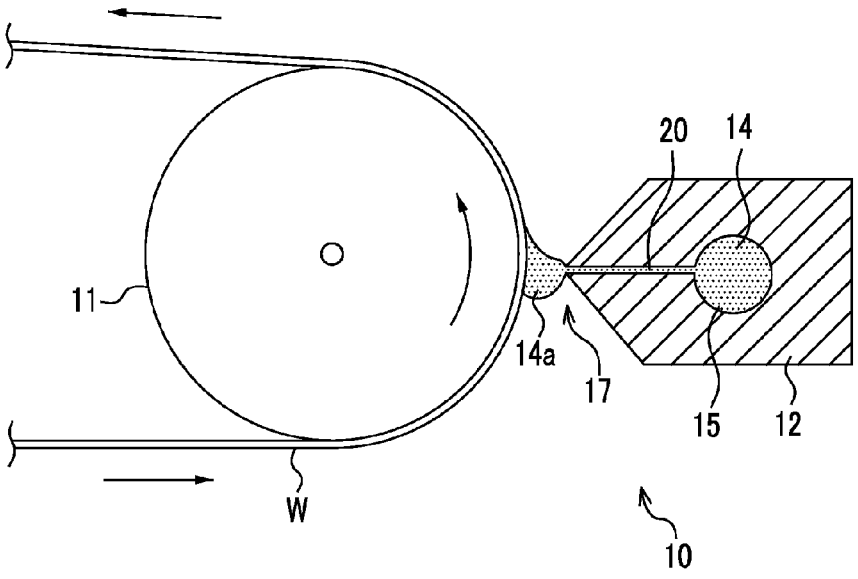
FIG. 2 is a schematic diagram illustrating the slot die according to the first invention and the third invention.

FIG. 2 shows a schematic diagram illustrating a coater unit that may use the slot die obtained by executing the first and third inventions. A coater unit 10 applies coating-liquid 14 as a bead 14*a* from the slot die 12 with respect to the web W traveling in succession while being supported by the backup roll 11, and forms a coating film on the web W.

A slot die 12 has a pocket 15 and a slot 20 formed at the inside thereof. The pocket 15 has a curved or linear cross-sectional shape. For example, as shown in FIGS. 1 and 2, the pocket 15 may have a cross-sectional shape such as a substantially circular shape, a substantially semi-circular shape, and a trapezoidal shape. The pocket 15 extends in the width direction of the slot die 12 with the cross-sectional shape and serves as a coating-liquid collecting space. In general, the effective extension length of the pocket 15 is equal to or longer than the application width. The supply of the coating-liquid 14 to the pocket 15 is performed from a side face of the slot die 12, or from the center of a face opposite the slot 20, and the pocket 15 is provided with a cap that prevents the coating-liquid 14 from being leaked.

The slot 20 is a flow path of the coating-liquid 14 onto the web W from the pocket 15, and has a cross-sectional shape in the width direction of the slot die 12 similarly to the pocket 15. An opening portion, which is located on the web W side, is adjusted to have approximately the same width as the application width by using a width regulating plate (not shown). An angle that is made by the slot tip-end of the slot 20 and a tangential line of the backup roll 11 in a web traveling direction thereof is generally 30° to 90°, and the effect of the first invention and the third invention is not limited to the slot die having the above-described shape.

A lip tip-end 17 of the slot die 12 in which the opening portion of the slot 20 is located is formed to have a tapered shape, and the tip-end thereof is formed as a flat portion called a lip face. In regard to the flat portion, the upstream side thereof in the traveling direction of the web W with respect to the slot 20 is referred to as the upstream-side lip land, and the downstream side is referred to as the downstream-side lip land.

Here, as a material of the slot die 12, stainless steel has been frequently used, but since the forming of the slot die 12, which has a sharp edge in which a length (also, referred to as a width) of the upstream side lip land and the downstream side lip land is 150 μm or less in the web traveling direction, is difficult, the material has shifted to an ultrahard material. However, the ultrahard material has a problem in corrosion resistance, and the ultrahard material is expensive and therefore is used only at the lip tip-end of the slot die. As a result, the ultrahard material is assembled only at a tip-end of a stainless steel block of the related art.

However, when performing the application with the slot die so as to correspond to recent demands for increases in production speed, an ultrahard fixing member formed at the lip tip-end is obstructive and particularly, in the slot die of a multi-layer application, it is difficult to form a heat retention hole at an intermediate block of the slot die. As a result, heat retention becomes impossible, and therefore the die block is thermally deformed. Therefore, the coating gap becomes uneven in the width direction, and it becomes difficult to suppress unevenness of the film thickness in the width direction.

To solve the problems, the present inventors found a method of manufacturing a member made by stainless steel which is capable of processing a sharp edge in stainless steel.

Hereinafter, a method of manufacturing a member made by stainless steel related to the first and third inventions will be described. In addition, a description will be made with respect to case in which the slot die is manufactured, but it is not limited to the slot die.

A method of manufacturing the member made by stainless steel according to the first invention includes a step of grinding a face which forms the sharp edge of the stainless steel in the longitudinal direction of the sharp edge, a step of grinding both side faces, which come into contact with each other in the longitudinal direction of the sharp edge, from the non-tip-end face of the sharp edge toward a tip-end direction of the sharp edge while grinding both the side faces in the longitudinal direction of the sharp edge, and a step of polishing the face which forms the sharp edge by moving a polishing unit in the longitudinal direction of the sharp edge.

Figure 3:
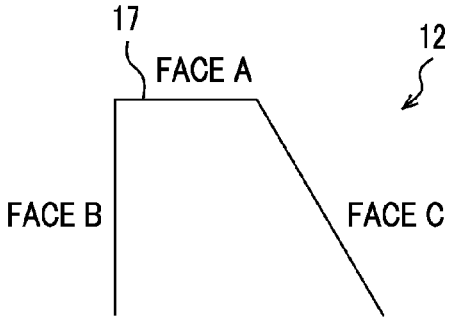
FIG. 3 is an explanatory diagram illustrating the method of manufacturing the member made by stainless steel according to the first invention and the third invention.

As shown in FIG. 3, in the case of forming the lip tip-end 17 of the slot die 12 as a sharp edge, first, a face A, which becomes the lip tip-end 17, is ground in the longitudinal direction of the stainless steel. Then, the face B and the face C, which become side faces, are ground from the non-tip-end face of the sharp edge toward a tip-end direction of the sharp edge while the face B and the face C are ground in the longitudinal direction of the stainless steel. The grinding sequence of the face B and the face C may be in the order of the face B and the face C, or in the order of the face C and the face B. Then, finally, the face A, which becomes the lip tip-end 17, is polished by moving a polishing unit in the longitudinal direction of the sharp edge.

Figure 4:
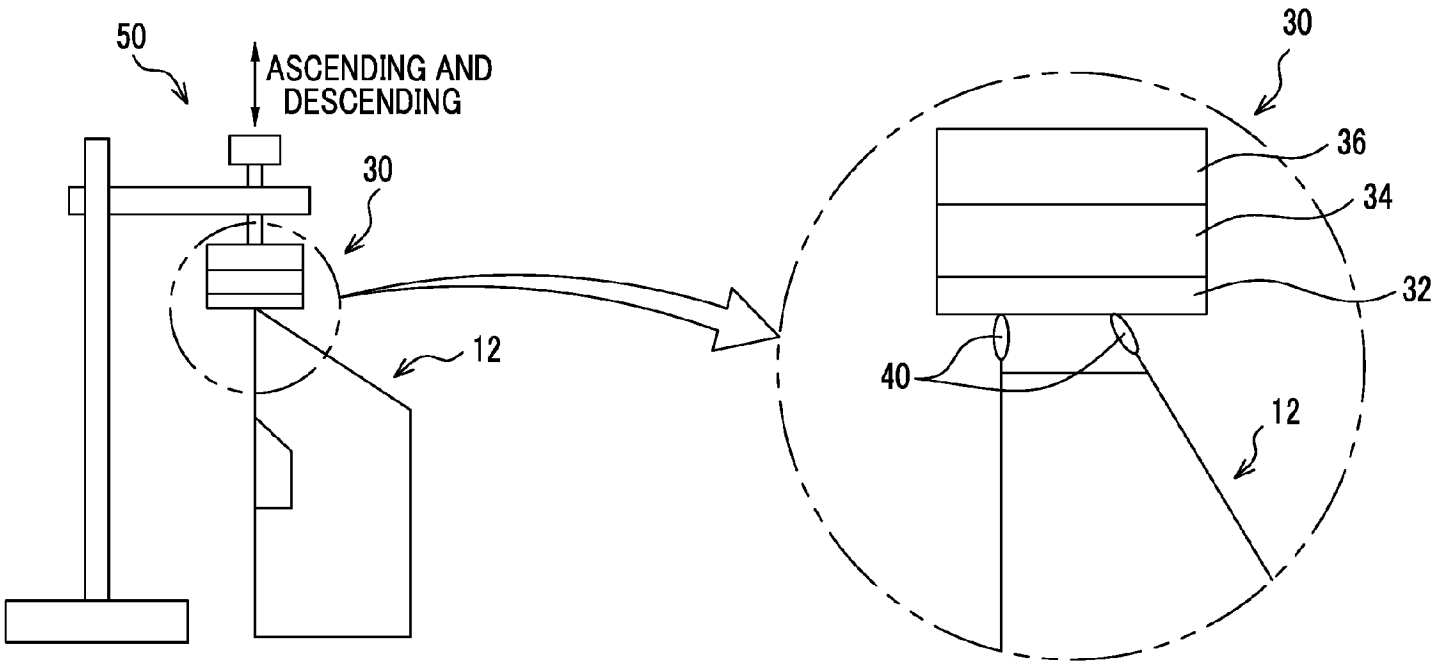
FIG. 4 is a schematic diagram illustrating a polishing unit that is used in the method of manufacturing the member made by stainless steel according to the first invention and the third invention.

The polishing of the face A will be described with reference to FIG. 4. The face A, which becomes the lip tip-end 17, is ground in the longitudinal direction of the stainless steel, and then the face B and the face C, which become the side faces, are ground from the non-tip-end face of the sharp edge toward the tip-end direction of the sharp edge while both the face B and the face C are ground in the longitudinal direction of the stainless steel. After these grinding processes, buffs 40 of the stainless steel are formed on the lip tip-end 17 side as shown in FIG. 4. Here, when polishing the burrs 40, the burrs 40 are polished by moving a polishing unit 30 in the longitudinal direction of the sharp edge (in FIG. 4, in a direction from a front side to a depth side or from a depth side to a front side).

When the stainless steel is ground and polished in this manner, the burrs 40 may be removed in a tidy manner, such that chipping of the sharp edge may be prevented from occurring.

In the first invention, it is preferable that the width of the sharp edge have 150 μm or less by grinding and polishing the stainless steel as described above.

In a case where the burrs remain and therefore chipping of the sharp edge occurs, the smaller the width of the sharp edge is, the more the problem becomes significant. Therefore, an effect of the first invention, that is, an effect of tidily removing the burrs becomes significant, when the width of the sharp edge is small, such as a value of 150 μm or less.

Furthermore, in the first invention, it is preferable that the polishing unit 30 be a polishing unit including a first layer 32 of abrasive grains, a second layer 34 of a soft member, and a third layer 36 of a supporting body having a rigidity higher than that of the second layer as shown in FIG. 4. Here, as the abrasive grains, abrasive grains of #4000 or more is preferable, as the soft member, a sponge or rubber is preferable, and as the supporting body, a metallic plate is preferable.

According to the first invention, when a soft material, which has a cushion property, such as the sponge and rubber, is provided between the abrasive grain layer and the supporting body as a polishing unit, it is possible to remove the burrs without applying a load to the burrs, such that chipping of the sharp edge does not occur.

Furthermore, the polishing unit 30 is mounted on an ascending and descending unit 50 as shown in FIG. 4 and it is preferable that the polishing be performed in a state where a desired pressure is applied to the burrs 40.

In addition, in a case where the material of the slot die is the ultrahard material, it is necessary that the slot die be replaced at a frequency of once every two years due to corrosion occurring at the lip tip-end, but in the case of the stainless steel slot die manufactured by the manufacturing method according to the first invention and the third invention, the corrosion-related problem is solved, and a film may be continuously and stably manufactured, and therefore a manufacturing yield ratio may be largely improved.

In addition, the method of manufacturing the member made by stainless steel according to the third invention includes a step a of grinding a face which forms the sharp edge and both side faces, which come into contact with each other in the longitudinal direction of the sharp edge, of the stainless steel, and a step b of polishing the face which forms the sharp edge, wherein in the step b, the polishing is performed using a polishing unit including a first layer of abrasive grains, a second layer of a soft member, and a third layer of a supporting body having a rigidity higher than that of the second layer in this order from the side that comes into contact with the face which forms the sharp edge.

As shown in FIG. 3, in the case of forming the lip tip-end 17 of the slot die 12 as a sharp edge, first, the face A, which becomes the lip tip-end 17, and the face B and the face C, which become side faces, are ground. The grinding sequence of the face B and the face C may be in the order of the face B and the face C, or in the order of the face C and the face B. Then, finally, the face A, which becomes the lip tip-end 17, is polished by moving a polishing unit described below in the longitudinal direction of the sharp edge.

In the third invention, it is preferable that the polishing unit 30 be a polishing unit including a first layer 32 of abrasive grains, a second layer 34 of a soft member, and a third layer 36 of a supporting body having a rigidity higher than that of the second layer as shown in FIG. 4. Here, the size of the abrasive grains is preferably #2500 or more, and the hardness of the soft member is preferably 35 or less. In addition, as the supporting body, a metallic plate is preferable.

When the stainless steel is ground and polished using the polishing unit 30, the burrs 40 may be tidily removed, and therefore chipping of the sharp edge may be prevented from occurring.

Furthermore, in the third invention, it is further preferable that the member made by stainless steel be manufactured by a step of grinding a face which forms the sharp edge of the stainless steel in the longitudinal direction of the sharp edge, a step of grinding both side faces, which come into contact with each other in the longitudinal direction of the sharp edge, from the non-tip-end face of the sharp edge toward the tip-end direction of the sharp edge while grinding both the side faces in the longitudinal direction of the sharp edge, and a step of polishing the face which forms the sharp edge by moving a polishing unit in the longitudinal direction of the sharp edge.

In this case, when forming the lip tip-end 17 of the slot die 12 in a sharp edge, first, the A face, which becomes the lip tip-end 17, is ground in the longitudinal direction of the stainless steel. Then, the B face and the C face, which become the side faces, are ground from the non-tip-end face of the sharp edge toward the tip-end direction of the sharp edge while both the face B and the face C are ground in the longitudinal direction of the stainless steel. The grinding sequence of the face B and the face C may be in the order of the face B and the face C, or in the order of the face C and the face B. Then, finally, the face A, which becomes the lip tip-end 17, is polished by moving a polishing unit in the longitudinal direction of the sharp edge.

In regard to the polishing of the face A, the face A, which becomes the lip tip-end 17, is ground in the longitudinal direction of the stainless steel, and then the face B and the face C, which become the side faces, are ground from the non-tip-end face of the sharp edge toward the tip-end direction of the sharp edge while both the face B and the face C are ground in the longitudinal direction of the stainless steel. After these grinding processes, burrs 40 of the stainless steel are formed on the lip tip-end 17 side as shown in FIG. 4. Here, when polishing the burrs 40, the burrs 40 are polished by moving a polishing unit 30 in the longitudinal direction of the sharp edge (in FIG. 4, in a direction from a front side to a depth side or from a depth side to a front side).

When the stainless steel is ground and polished in this manner, the burrs 40 may be removed in a tidy manner, such that chipping of the sharp edge may be prevented from occurring.

According to the third invention, when a soft material, which has a cushion property, such as a sponge and rubber with a hardness of 35 or less, is provided between the abrasive grain layer and the supporting body as a polishing unit, it is possible to remove the burrs without applying a load to the burrs, such that chipping of the sharp edge does not occur.

The polishing unit 30 is mounted on an ascending and descending unit 50 as shown in FIG. 4 and it is preferable that the polishing be performed in a state where a desired pressure is applied to the burrs 40.

In addition, in a case where the material of the slot die is the ultrahard material, it is necessary to replace the slot die at a frequency of once every two years due to corrosion occurring at the lip tip-end, but in the case of the stainless steel slot die manufactured by the manufacturing method according to the third invention, the corrosion-related problem is solved, and a film may be continuously and stably manufactured, and therefore a manufacturing yield ratio may be largely improved.

Example A

Slot dies (extrusion type coaters) having a block width of 1000 mm and a block height of 150 mm were manufactured by using materials described in Table 1 of FIG. 5, and as a grinding machine used in the final processing of a block, a surface grinding machine (DSG 205) manufactured by OKAMOTO MFG CO., LTD. was used, and measurement of hardness was performed using a rubber harness meter (Asker-FP type) manufactured by KOBUNSHI KEIKI CO., LTD. In addition, observation of a lip tip-end after deburring was performed using a microscope VHX900 manufactured by Keyence Corporation.

As described in Table 1 of FIG. 5, in Example 1 and Comparative Examples 2, 3, 5, and 6, SUS630 was used as a material, in Example 2 and Comparative Example 1, SUS329J1 was used as the material, and in Example 3 and Comparative Example 4, ASL438 was used as the material.

In addition, in Examples 1 to 3 and Comparative Examples 1 and 2, the grinding was performed in the block width direction (longitudinal direction of a sharp edge) from the non-tip-end face of the sharp edge toward a tip-end direction of the sharp edge, and in Comparative Examples 3 to 6, the grinding was performed in a direction orthogonal to the block width direction (the longitudinal direction of the sharp edge).

In addition, in Examples 1 and 2 and Comparative Examples 2, 3, 5, and 6, the grinding was performed in the order of the face A, the face B, and the face C shown in FIG. 3, in Example 3 and Comparative Example 4, the grinding was performed in the order of the face A, the face C, and the face B, and in Comparative Example 1, the grinding was performed in the order of the face B, the face A, and the face C.

In addition, in Comparative Example 2, the polishing was performed in a direction orthogonal to the block width direction (the longitudinal direction of the sharp edge) as a polishing direction, and in Examples 1 to 3 and Comparative Examples 1, 3 to 6 other than Comparative Example 2, the polishing was performed in the block width direction (the longitudinal direction of the sharp edge).

In addition, as the polishing unit, a unit having a structure shown in FIG. 4 was used, and as abrasive grains of the polishing unit, #2000 sandpaper was used in Comparative Example 4, #4000 sandpaper was used in Examples 1 and 3 and Comparative Examples 2, 5, and 6, and #8000 sandpaper was used in Example 2 and Comparative Examples 1 and 3, each sandpaper was manufactured by 3M corporation. In addition, as the soft member of the polishing unit, a sponge material having hardness listed in Table 1 of FIG. 5, and as the supporting body of the polishing unit, a metallic plate was used.

A situation of burrs and chipping of the lip when the sharp edge was formed with stainless steel in this manner were evaluated, and from this evaluation, A to D were described as an overall evaluation (Table 1).

As can be seen from Table 1 of FIG. 5, in slot dies that were manufactured by a method of manufacturing a member made by stainless steel, the method including a step of grinding a face which forms the sharp edge of the stainless steel in the longitudinal direction of the sharp edge, a step of grinding both side faces, which come into contact with each other in the longitudinal direction of the sharp edge, from the non-tip-end face of the sharp edge toward a tip-end direction of the sharp edge while grinding both the side faces in the longitudinal direction of the sharp edge, and a step of polishing the face which forms the sharp edge by moving a polishing unit in the longitudinal direction of the sharp edge, the burrs were removed in a preferable manner, and chipping of the sharp edge did not occur. More specifically, when the polishing was performed using the polishing unit including a first layer of abrasive grains, a second layer of a soft member, and a third layer of a supporting body having a rigidity higher than that of the second layer, it was found that abrasive grains of #4000 or more were preferable, and a soft member with hardness of 21 or less was preferable.

Example B

Experiment 1

Slot dies (extrusion type coaters) having a block width of 1000 mm and a block height of 150 mm were manufactured by using materials described in Table 2 of FIG. 6, and as a grinding machine used in a final processing of a block, a surface grinding machine (DSG 205) manufactured by OKAMOTO MFG CO., LTD. was used, and measurement of hardness was performed using a rubber harness meter (FP type) manufactured by Asker Corporation. In addition, observation of a lip tip-end after deburring was performed using a microscope VHX900 manufactured by Keyence Corporation.

As described in Table 2 of FIG. 6, in Examples 1-1 and 1-4 and Comparative Examples 1-2, 1-3, 1-5, and 1-6, SUS630 was used as the material, in Example 1-2 and Comparative Example 1-1, SUS329J1 was used as the material, and in Example 1-3 and Comparative Example 1-4, ASL438 was used as the material.

In addition, as the polishing unit, a unit having a structure shown in FIG. 4 was used, and as abrasive grains, #2000 sandpaper was used in Comparative Example 1-1, #4000 sandpaper was used in Example 1-1 and Comparative Example 1-3, #6000 sandpaper was used in Example 1-2 and Comparative Example 1-4, #8000 sandpaper was used in Example 1-3 and Comparative Example 1-5, and #10000 sandpaper was used in Example 1-4 and Comparative Example 1-6, each sandpaper was manufactured by 3M corporation. In addition, as the soft member of the polishing unit, a silicone sponge Si001, which has hardness listed in Table 2 of FIG. 6 and was manufactured by Fuso Rubber Corporation, was used, and as the supporting body of the polishing unit, a metallic plate was used. In addition, the polishing direction in the deburring was set to the width (longitudinal) direction, and the polishing was performed at a constant pressing pressure of 5 N.

A situation of burrs and the chipping of the lip when the sharp edge was formed with stainless steel in this manner were evaluated, and from this evaluation, A to E were described as an overall evaluation (Table 2).

As can be seen from Table 2 of FIG. 6, in a case where the polishing was performed using the polishing unit including a first layer of abrasive grains, a second layer of a soft member, and a third layer of a supporting body having a rigidity higher than that of the second layer, the size of the abrasive grains was #2500 or more, and the hardness of the soft member was 35 or less, a preferable result was obtained.

Experiment 2

Similarly to Experiment 1, Slot dies (extrusion type coaters) having a block width of 1000 mm and a block height of 150 mm were manufactured by using materials described in Table 3 of FIG. 7, and as a grinding machine used in a final processing of a block, a surface grinding machine (DSG 205) manufactured by OKAMOTO MFG CO., LTD. was used, and measurement of hardness was performed using a rubber harness meter (Asker-FP type) manufactured by KOBUNSHI KEIKI CO., LTD. In addition, observation of a lip tip-end after deburring was performed using a microscope VHX900 manufactured by Keyence Corporation.

As described in Table 3 of FIG. 7, in Example 2-1 and Comparative Examples 2-2, 2-3, 2-5, and 2-6, SUS630 was used as the material, in Example 2-2 and Comparative Example 2-1, SUS329J1 was used as the material, and in Example 2-3 and Comparative Example 2-4, ASL438 was used as the material.

In addition, in Examples 2-1 to 2-3 and Comparative Example 2-1, the grinding was performed in the block width direction (the longitudinal direction of the sharp edge) from the non-tip-end face of the sharp edge toward the tip-end direction of the sharp edge, and in Comparative Examples 2-3 to 2-6, the grinding was performed in a direction orthogonal to the block width direction (the longitudinal direction of the sharp edge).

In addition, in Examples 2-1 and 2-2 and Comparative Examples 2-3, 2-5, and 2-6, the grinding was performed in the order of the face A, the face B, and the face C shown in FIG. 3, in Example 2-3 and Comparative Example 2-4, the grinding was performed in the order of the face A, the face C, and the face B, and in Comparative Example 2-1, the grinding was performed in the order of the face B, the face A, and the face C.

In addition, as the polishing unit, a unit having a structure shown in FIG. 4 was used, and as abrasive grains of the polishing unit, #2000 sandpaper was used in Comparative Example 2-4, #4000 sandpaper was used in Examples 2-1 and 2-3 and Comparative Examples 2-5 and 2-6, #8000 sandpaper was used in Example 2-2 and Comparative Examples 2-1 and 2-3. In addition, as the soft member, a silicone sponge Si001, which has hardness described in Table 3 of FIG. 7 and was manufactured by Fuso Rubber Corporation, was used, and as the supporting body of the polishing unit, a metallic plate was used. In addition, the polishing direction in the deburring was set to the width (longitudinal) direction, and the polishing was performed at a constant pressing pressure of 5 N.

A situation of burrs and chipping of the lip when the sharp edge was formed with stainless steel in this manner were evaluated, and from this evaluation, A to E were described as an overall evaluation (Table 3).

As can be seen from Table 3 of FIG. 7, in slot dies that were manufactured by a method of manufacturing a member made by stainless steel, the method including a step of grinding a face which forms the sharp edge of the stainless steel in the longitudinal direction of the sharp edge, a step of grinding both side faces, which come into contact with each other in the longitudinal direction of the sharp edge, from the non-tip-end face of the sharp edge toward a tip-end direction of the sharp edge while grinding both the side faces in the longitudinal direction of the sharp edge, and a step of polishing the face which forms the sharp edge by moving a polishing unit in the longitudinal direction of the sharp edge, the burrs were removed in a preferable manner, and chipping of the sharp edge did not occur.

More specifically, when the polishing was performed using the polishing unit including a first layer of abrasive grains, a second layer of a soft member, and a third layer of a supporting body having a rigidity higher than that of the second layer, it was found that abrasive grains of #2500 or more were preferable, and a soft member with hardness of 35 or less was preferable.

What is claimed is:

1. A method of manufacturing a member made of stainless steel, comprising:

a first step of grinding a face which forms a tip-end sharp edge of the stainless steel member in a longitudinal direction of the sharp edge;

a second step of grinding both side faces from a point away from a tip-end face of the sharp edge toward a tip-end face of the sharp edge while grinding both the side faces in the longitudinal direction of the sharp edge; and a third step of polishing the face which forms the ti-end sharp edge by moving a polishing unit in the longitudinal direction of the sharp edge.

2. The method according to claim 1, wherein a width of the sharp edge is 150 μm or less.

3. The method according to claim 1, wherein the polishing unit includes a first layer of abrasive grains, a second layer of a soft member, and a third layer of a supporting body having a rigidity higher than that of the second layer.

4. The method according to claim 1, wherein the stainless steel is a member for a slot die, and the sharp edge is a lip face of the slot die.

5. A method of manufacturing a coating film, the method including:

coating a coating-liquid onto a base using the slot die manufactured by the method of manufacturing the member made by stainless steel according to claim 4.

6. A method of manufacturing a member made of stainless steel, comprising:

a first step of grinding a face which forms a tip-end sharp edge, a second step of grinding both side faces of the stainless steel member; and a third step of polishing the face which forms the tip-end sharp edge, wherein the third step of polishing of the face which forms the tip-end sharp edge is performed using a polishing unit including a first layer of abrasive grains, a second layer of a soft member, and a third layer of a supporting body having a rigidity higher than that of the second layer, in the order from a side that comes into contact with the face which forms the tip-end sharp edge.

7. The method according to claim 6, wherein a size of the abrasive grains is #2500 or more.

8. The method according to claim 6, wherein the first step of grinding of a face which forms a tip-end sharp edge and the second step of grinding of both side faces of the stainless steel member includes, a step of grinding a face which forms a tip-end sharp edge of the stainless steel member in a longitudinal direction of the sharp edge, and a step of grinding both side faces from a point away from a tip-end face of the sharp edge toward a tip-end face of the sharp edge while grinding both the side faces in the longitudinal direction of the sharp edge, and wherein the third step of polishing of the face which forms the ti-end sharp edge includes, a step of polishing the face which forms the ti-end sharp edge by moving a polishing unit in the longitudinal direction of the sharp edge.

9. The method according to claim 6, wherein the stainless steel is a member for a slot die, and the sharp edge is a lip face of the slot die.

10. A method of manufacturing a coating film, the method comprising:

coating a coating-liquid onto a base using the slot die manufactured by the method of manufacturing the member made by stainless steel according to claim 9.

11. The method according to claim 3, wherein the supporting body is a metallic plate.

12. The method according to claim 6, wherein the supporting body is a metallic plate.

13. The method according to claim 1, wherein a length of the sharp edge is at least 1000 mm or more.

14. The method according to claim 3, wherein a length of the sharp edge is at least 1000 mm or more.

* * * * *